United States Patent [19]

Larsen

[11] 4,422,357

[45] Dec. 27, 1983

[54] APPARATUS FOR ADVANCING A PREDETERMINED LENGTH OF STRIP-SHAPED MATERIAL

[76] Inventor: Mogens D. Larsen, Teglvaerksvej 22, DK-4450 Jyderup, Denmark

[21] Appl. No.: 276,371

[22] PCT Filed: Oct. 13, 1980

[86] PCT No.: PCT/DK80/00061

§ 371 Date: Jun. 11, 1981

§ 102(e) Date: Jun. 11, 1981

[87] PCT Pub. No.: WO81/00999

PCT Pub. Date: Apr. 16, 1981

[30] Foreign Application Priority Data

Oct. 15, 1979 [DK] Denmark ..... 4346/79

[51] Int. Cl.[3] ..... B26D 5/32

[52] U.S. Cl. ..... 83/210; 83/276; 83/277; 83/367; 83/371; 226/114

[58] Field of Search ..... 83/276, 277, 209, 210, 83/367, 371; 226/114

[56] References Cited

U.S. PATENT DOCUMENTS

| | | | |
|---|---|---|---|
| 1,859,962 | 5/1932 | Ferenci | 226/114 X |
| 3,175,444 | 3/1965 | Spinney | 83/276 X |
| 3,702,673 | 11/1972 | Zernov et al. | 226/114 X |
| 3,776,441 | 12/1973 | Forthmann, Jr. et al. | 226/114 |
| 4,011,708 | 3/1977 | Brown, Jr. | 226/114 X |
| 4,079,645 | 3/1978 | Nunes et al. | 83/277 X |

FOREIGN PATENT DOCUMENTS

| | | | |
|---|---|---|---|
| 227279 | 8/1943 | Switzerland | 226/114 |

*Primary Examiner*—Frank T. Yost

[57] ABSTRACT

An apparatus for advancing a predetermined length of strip material from a supply roll to a delivery point. In addition to strip pull-off mechanism (15) cooperating with a one-way means (20, 22) to pull-off the desired strip length from the supply roll (10), the apparatus has a gripper (26) reciprocating in synchronism and in push-pull connection with the pull-off mechanism, the gripper gripping and advancing the strip end. The strip (11) also passes a strip brake (20, 21) and a photocell (19) which on detection of a suitable mark causes the brake to be actuated to stop the strip and the gripper to be actuated so that it releases the strip. As the moving parts have a very small inertia, the braking may be effected almost instantaneously and with great precision.

6 Claims, 5 Drawing Figures

16
15
14
10
17
11
18
19
12
27
28
26
13
29
25
24
23
21
20
22

47
45
43
42
15
41
40
46
44
33
32
30
31
72
73
68
34
38
66
67
69
71
37
35
70
50
48
52
51
26
60
59
62
61
36
39
49
58
65
21
64
63
60
59

APPARATUS FOR ADVANCING A PREDETERMINED LENGTH OF STRIP-SHAPED MATERIAL

The invention relates to an apparatus for advancing a predetermined length of strip-shaped material from a supply roll to a delivery point. Such apparatus includes a pull-off mechanism having a reciprocable pull-off means over which the strip runs, and a one-way means disposed between this mechanism and the delivery point, through which the strip runs.

The Danish patent specification No. 130 883 discloses an apparatus of this type for applying handles to parcels which are moved past in substantially equidistant positions on a conveyor, and this apparatus has an applying means that is connected to the pull-off means and which moves in and out of the gap between two parcels while exerting a resilient pressure against the parcels to attach adhesive faces of the strip to the side faces of the parcels. The apparatus also has a knife which on attachment of the strip moves down between the parcels and cuts the strip length between them. The function of the apparatus thus relies on each handle having been applied to a parcel before said handle is severed from the strip.

However, it is desirable in many cases that the apparatus can deliver a ready, severed handle at a delivery point where it can be held in a waiting position by a suitable holding assembly. The object of the invention is to provide an apparatus of the present type which can solve this task with great precision, i.e. in such a way that the severed handle is given exactly the desired predetermined length and is placed exactly in the holding assembly.

This object is achieved by the provision of a gripper arranged to be reciprocated in synchronism with the pull-off means and, at its one extreme position, to grip the end of the strip of material, as well as a strip brake and a detector arranged to detect a mark on the strip and in response thereto cause the gripper to open so as to release the strip, and the strip brake to be actuated. The detector, which may e.g. be a photocell, can determine the strip position with an almost arbitrarily desired precision, and the only moving parts which the detector signal is to actuate are one jaw of the gripper, the strip brake and a short length of the strip itself. These parts have quite a small mass so that the processes required to stop the strip can be effected practically instantaneously.

Simple embodiments of the drive mechanisms of the pull-off means and the gripper and of means for synchronizing their movements are described below.

The advantage of a further embodiment of the apparatus is that the strip length advanced per working cycle may be varied merely by displacing a pneumatic cylinder and the impact point of a piston rod on a pivot arm, such adjustment having no influence on the relation between the two controlled movements.

Shears controlled as stated in claim 6 may expediently be used for separating the advanced strip length from the rest of the strip.

The invention will be explained more fully below with reference to the drawing, in which.

Figure 1:
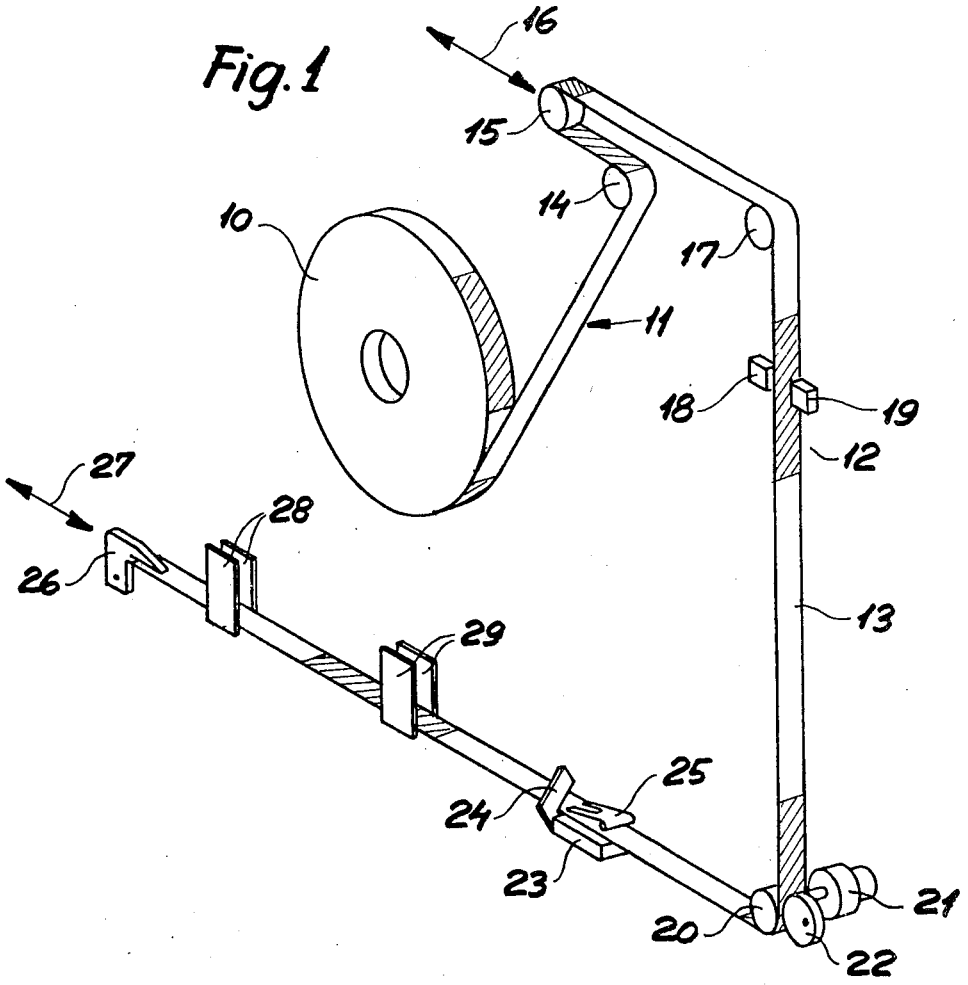
FIG. 1 is a diagrammatic and inclined axonometric view showing the parts of an embodiment of the apparatus of the invention which are disposed along the strip path itself, as well as a strip roll and a strip being advanced.
Figure 2:
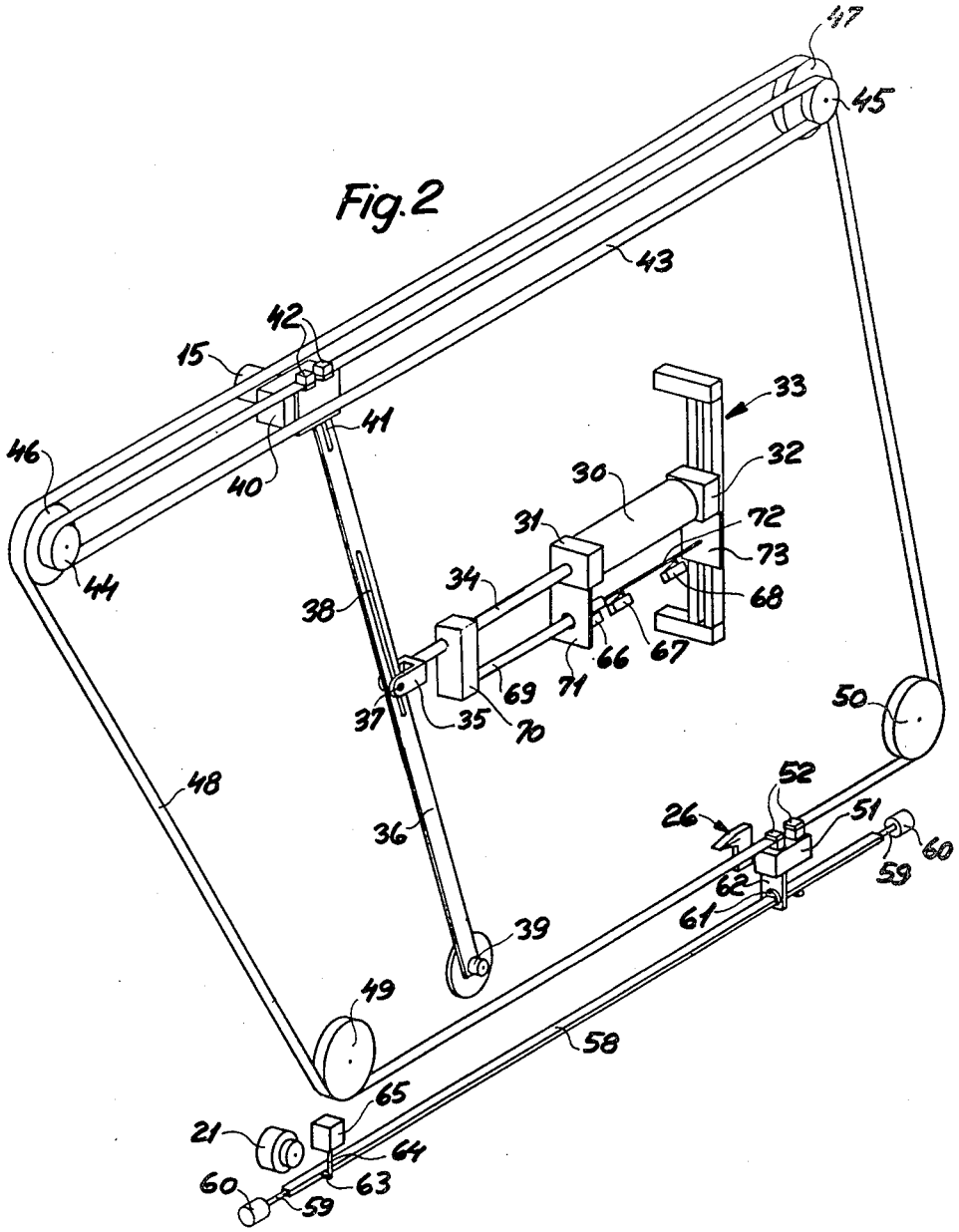
FIG. 2 is a likewise diagrammatic and inclined axonometric view showing the drive mechanisms of the moving parts.

The parts shown in FIGS. 1 and 2 may e.g. be mounted at their respective sides of a mounting plate, not shown. In FIG. 1 the symbol 10 designates a roll of strip material 11 intended to form handles for application to parcels, not shown. The strip may e.g. be polypropylene with adhesive on one side to which a piece of paper 12 adheres at intervals, and the strip is severed at the center of the adhesive sections 13 so as to impart to each handle a non-adhesive center portion 12 and two end portions that may adhere to a parcel.

From the roll 10 the strip 11 runs over a roller 14 and from there around a pull-off roller 15 that may be reciprocated in a rectilinear path as indicated by a double arrow 16. From the pull-off roller 15 the strip passes around a roller 17 and from there through a detector in the form of a light source 18 and a photocell 19 whose output signal changes upon the passage from a non-adhesive to an adhesive portion of the strip and vice versa, to a brake roller 20 firmly connected to a magnet brake 21. The brake roller 20 also acts as a one-way means in cooperation with an eccentrically journalled roller 22, said rollers only permitting the strip to move in the feeding direction. From the brake roller 20 the strip passes through shears comprising a lower plate 23 and a knife 24 pivotally mounted on the plate. A spring clip 25 keeps the strip slightly pressed against the lower plate 23. Having passed through the shears the strip reaches the delivery point of the handle, pulled by a gripper 26 that can be reciprocated in a rectilinear path as indicated by a double arrow 27. Having been severed the handle may be held in the delivery position by means of a suitable holder whose arrangement depends upon the mechanism used for passing on the handle to the parcel to which it is to be applied. In FIG. 1 the holder is shown as two pairs of opposite plates 28 and 29 which may be covered with thin bristles on the sides facing each other, and the severed handle may be held between them with its non-adhesive center portion 12 located between the pairs of plates 28 and 29.

In FIG. 2 the symbol 30 designates a drive cylinder with end pieces 31 and 32, the rear one 32 being attached to a supporting device 33 fitted on the mounting plate such that the cylinder may be vertically adjusted. The end of the piston rod 34 of the cylinder mounts a fork 35 that grips a pivot arm 36 and is pivotally and slidably connected to it by means of pin 37 extending between the fork prongs and through a slot 38 in the pivot arm. The pivot arm 36 has its lower end pivotally journalled on the mounting plate by means of a pivot 39, and its upper end pivotally and slidably connected to a carrier block 40 by means of a pin-slot connection, only the slot 41 of which is shown in the drawing. The carrier block 40 also carries the pull-off roller 15, shown in FIG. 1, on a shaft (not shown), which extends through a, horizontal slot (not shown) in the mounting plate. The carrier block 40 has attached to it the two ends of a toothed belt 43 by means of clamping members 42, said belt 43 running about two toothed pulleys 44 and 45 which are disposed at the same level and have the same number of teeth.

Figure 3:
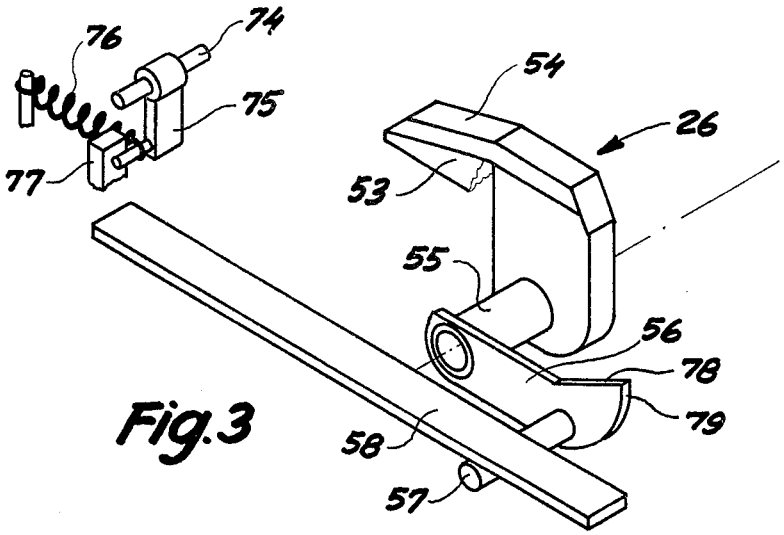
FIGS. 3 and 4 are diagrammatic, inclined axonometric views showing parts of the gripper and its operating mechanism in a closed and an open state, respectively.
Figure 4:
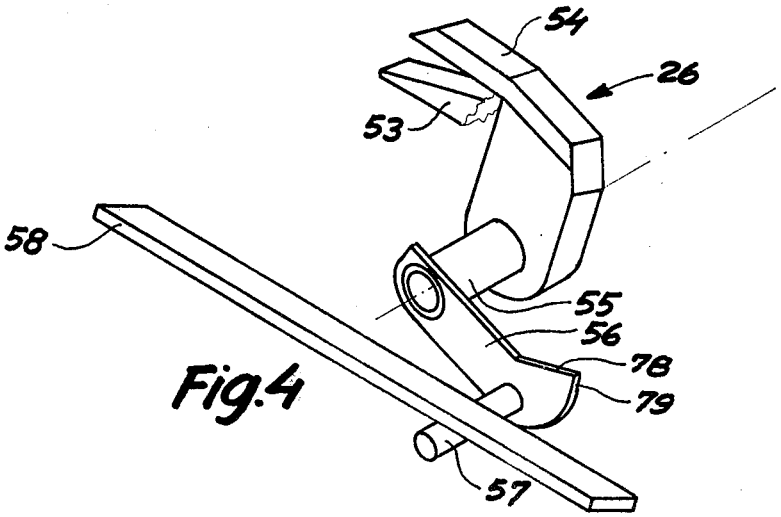

Each of the toothed pulleys 44 and 45 is firmly connected to another toothed pulley 46 and 47, respectively, which has twice as many teeth as the first-mentioned ones and about which another toothed belt 48 runs which further runs about two lower toothed pulleys 49 and 50, between which the toothed belt 48 extends along the path of movement of the gripper 27, and its ends are secured to a carrier block 51 for the gripper by means of two clamping members 52. As shown in FIGS. 3 and 4, the gripper 26 has two jaws 53 and 54, the lower jaw 53 being firmly connected to the carrier block 51 in a manner not shown in detail, the upper jaw 54 being disposed on one end of a shaft 55 that is rotatably connected to the carrier block and extends through a, horizontal slot (not shown) in the mounting plate, and on whose end a crank arm 56 with a crank 57 is mounted. A spring (not shown) urges the crank into engagement with the underside of a flat rail 58 extending along the path of movement of the gripper 26 and a distance beyond it at either end. End pins 59 of the rail 58 are pivotally journalled in bearings 60. The rail 58 also extends with a sliding fit through a bushing 61 which is rotatably journalled in a downwardly extending bracket 62 on the carrier block 51. Near its one end the rail 58 has a laterally protruding, short arm 63 which is pivotally connected to a rod 64 which may be reciprocated a short distance by an electromagnet 65. In the position shown in FIG. 3, the electromagnet 65 is deenergized, and the rail 58 lies in a horizontal position. In the position shown in FIG. 4, the electromagnet is energized and has turned the rail 58 through a small angle where it has pressed the crank 57 a little downwards and thus in turn rotated the gripper shaft 55 with the upper jaw 54 to open the gripper 26.

For opening the gripper 26 just before it is to grip the strip in its one extreme position a pawl 75 is provided at this point, said pawl being journalled on a pivot 74 and kept in resilient engagement with a stopper 77 by a tension spring 76; at the passage of the gripper the pawl engages an inclined cam edge 78 at the end of the crank arm 56, pressing said arm down to briefly open the gripper. During the passage of the gripper in the opposite direction the end edge 79 of the crank arm pivots the pawl 75 outwardly against the action of the spring 76.

Three micro-switches 66, 67 and 68 are fitted at the pneumatic cylinder 30 to control certain functions and are operated by a tube 69 which is firmly connected to the piston rod 34 through a transom 70 and slidably extends through a hole in a plate 71, which is supported by the front cylinder end piece 31 and is slidable on a rod 72 secured to a plate 73 on the rear cylinder end piece 32.

In FIGS. 1 and 2 the apparatus is shown in an advancing step shortly before the completion of it. Thus, the gripper 26 has closed about the end of the strip 11 and is moving to the left in FIG. 1 (to the right in FIG. 2) driven by the pneumatic cylinder 30 whose piston rod 34 approaches its extreme position, through the pivot arm 36, the carrier block 40 for the pull-off roller 15, the toothed belt 43, the toothed pulleys 44–47, the toothed belt 48, and the carrier block 51 for the gripper and carrying the strip. It will be seen that the pull-off roller 15 moves in a direction opposite to and at half the speed of the gripper 26 so that the gripper does not have to exert a greater tensile force than that required to overcome quite small frictional forces. In this state both the pull magnet 65 of the rail 58 and the magnet brake 21 are deenergized.

Figure 5:
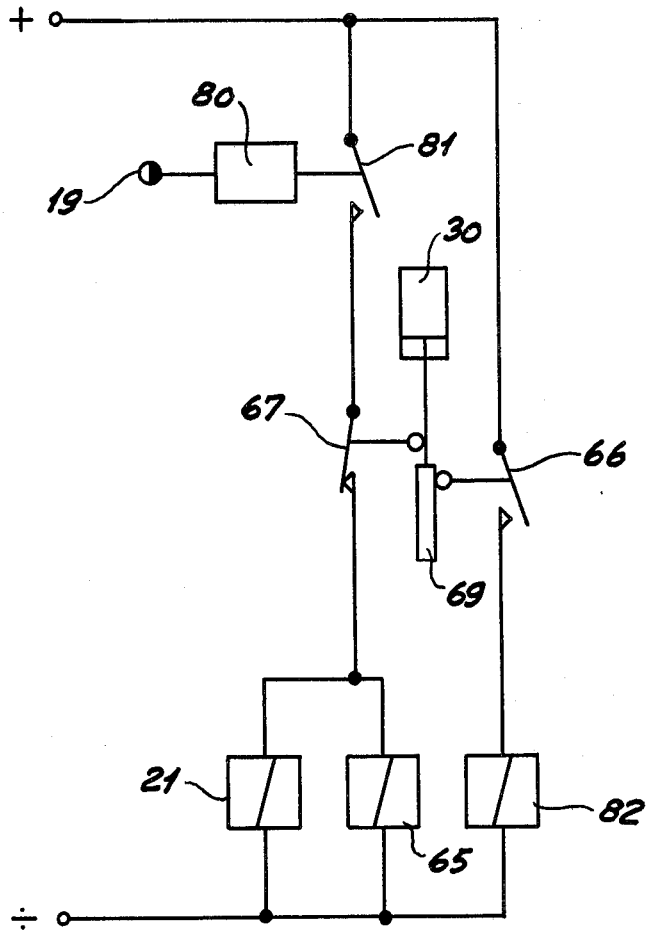
FIG. 5 is a wiring diagram of an electric circuit for the control of certain apparatus functions.

The photocell 19 is so disposed that the transition from a non-adhesive portion 12 to an adhesive portion 13 of the strip 11 reaches it simultaneously with the arrival of the front handle portion at the delivery point where its non-adhesive portion is located between the holders 28 and 29. When the photocell detects said transition, it causes, (see FIG. 5) via an amplifier 80, a make contact 81 to be closed, so that the brake magnet 65 and the pull magnet 21 connected in parallel to the magnet 65 are energized through the microswitch 67, which is a break contact, operated by the cylinder 30. The energization of the pull magnet 21 causes the rail 58 to be pivoted about the pins 59 and thus the gripper 26 to be opened in the manner described above, and the energization of the brake magnet 21 causes the strip movement to be stopped instantaneously as the moving masses are very small and the inertia counteracting the braking is correspondingly low. The strip is stopped just before the cylinder piston reaches its most advanced position, and thus the gripper moves on a small distance after having released the strip 11. Immediately before the cylinder piston reaches its extreme advanced position the tube 69 allows the microswitch 66, which is a break contact, to be released so as to close an energizing circuit for a magnet 82, which, in a manner (not shown) either directly or indirectly through a valve and a pneumatic cylinder, actuates the knife 24 to sever the strip.

The apparatus is now in an extreme position in which it may remain until an external order signal via a control valve (not shown) for the pneumatic cylinder 30 actuates it to retract the piston, or the control valve may be actuated via the microswitch 66 to automatically initiate a new working cycle, it being contemplated that in this case the handle just advanced is removed immediately after it has been cut free. As soon as the piston cylinder begins its return movement to pull out a new handle length of strip material from the supply roll 10 by means of the pull-off roller 15 and to return the gripper 26 to the new strip end in the shears 23, 24, the switch 66 is operated by the tube 69 which results in the knife 24 pivoting back to the position shown in FIG. 1. When the cylinder piston has moved a certain distance, the tube 69 operates the switch 67 to break the energizing circuits of the magnets 21 and 65 so that the magnet brake is deactivated and the gripper closes. Shortly before the gripper arrives at the shears 23, 24 it is opened by the cooperation between the cam edge 78 and the pawl 75 in the manner described above, and immediately before it reaches its extreme position it is closed again by its spring (not shown) so as to grip the strip end. At the same time the microswitch 68 is actuated by the tube 69 and causes, in a generally known manner, the pneumatic cylinder to be reversed so that the piston again begins moving outwards. When the gripper 26 has moved so far that the next non-adhesive region 12 on the strip 11 has reached the photocell 19, said cell causes the contact 81 to open, and not until this has taken place does the tube 69 allow the switch 67 to close again in preparation of the energizing circuits for the magnets 21 and 65. The apparatus is now again in the first described state shown in FIGS. 1 and 2.

It will be seen that the stroke of the movement of the pull-off roller and the gripper will be changed in the same proportion by displacement of the cylinder along the supporting device 33, which results in a corresponding change of the strip length fed per cycle. Thus, adaption to another handle length does not require the microswitches 66, 67 and 68 to be adjusted or the stroke of the cylinder to be changed. The pivot axis of the pivot arm 36 is so disposed in relation to the cylinder supporting device 33 that the center point of the handle is always situated between the holders 28 and 29 irrespective of the handle length to which the apparatus is adjusted.

I claim:

1. An apparatus for advancing a predetermined length of strip-shaped material from a supply roll to a delivery point, comprising: a pull-off mechanism having a reciprocable pull-off means over which the strip runs, a one-way means through which the strip runs, said one-way means being disposed between said mechanism and the delivery point, a gripper arranged to be reciprocated in synchronism with said pull-off means and, at its one extreme position, to grip the end of the strip of material, a strip brake, and a detector arranged to detect a mark on the strip and in response thereto cause the gripper to open so as to release the strip, and said strip brake to be actuated.

2. An apparatus according to claim 1 wherein said gripper is firmly connected to a toothed belt along a section between two toothed pulleys, and wherein said pull-off means is firmly connected to another toothed belt on a section between two other toothed pulleys, and wherein said two pairs of toothed belts are coupled together through a transmission mechanism having a transmission ratio of 2:1, and drive means for one toothed belt.

3. An apparatus according to claim 2, wherein said pulleys have shafts and wherein at least one of the shafts of the toothed pulleys of said pull-off means belt has mounted thereon another toothed pulley which is non-rotatably connected to said pull-off means pulley and has twice as many teeth as said pull-off means pulley, and about which said gripper toothed belt runs.

4. An apparatus according to claim 2 or 3, wherein said drive means are a pneumatic cylinder with a piston rod operatively connected to one toothed belt.

5. An apparatus according to claim 4, wherein said piston rod is pivotally connected to a pivot arm which is pivotally journalled at one end thereof and connected to a drive belt at the other end thereof such that the connection between the piston rod and the pivot arm is adjustable along said arm, and wherein said pneumatic cylinder is disposed so as to be adjustable in the plane of movement of the pivot arm substantially perpendicularly to its longitudinal axis.

6. An apparatus according to any one of claims 1 to 3, comprising shears arranged to sever the strip, said shears being actuated just before the gripper reaches its extreme position after having released the strip.

* * * * *